US012378719B1

(12) United States Patent
Chen

(10) Patent No.: US 12,378,719 B1
(45) Date of Patent: Aug. 5, 2025

(54) HANGING SET FOR IRONING BOARDS

(71) Applicant: Xue-feng Chen, Guangzhou (CN)

(72) Inventor: Xue-feng Chen, Guangzhou (CN)

( * ) Notice: Subject to any disclaimer, the term of this patent is extended or adjusted under 35 U.S.C. 154(b) by 0 days.

(21) Appl. No.: 18/644,147

(22) Filed: Apr. 24, 2024

(51) Int. Cl.
*A47G 29/08* (2006.01)
*D06F 81/06* (2006.01)

(52) U.S. Cl.
CPC ..... *D06F 81/06* (2013.01); *A47G 29/08* (2013.01)

(58) Field of Classification Search
CPC . A47G 29/08; A47L 9/24; A47B 81/00; F16B 12/00; D06F 81/06; D06F 81/00; D06F 79/02
See application file for complete search history.

(56) References Cited

U.S. PATENT DOCUMENTS 4,657,249 A * 4/1987 Offutt ..... A63B 21/16 248/539
5,483,761 A * 1/1996 Simpson ..... D06F 81/06 248/205.5
5,810,304 A * 9/1998 Lehrman ..... D06F 81/00 248/308
5,950,337 A * 9/1999 Lehrman ..... D06F 81/06 38/103
5,988,570 A * 11/1999 Gretz ..... H02G 3/32 248/89
6,003,691 A * 12/1999 Owen ..... A47B 81/02 211/65
6,695,155 B1 * 2/2004 Sofy ..... D06F 81/006 211/87.01
6,764,052 B1 * 7/2004 Wise ..... A45D 20/12 248/304
7,959,020 B2 * 6/2011 Rosen ..... D06F 79/02 248/302
8,083,079 B2 * 12/2011 Rosen ..... D06F 79/02 248/302
8,616,385 B1 * 12/2013 Doran ..... A63B 60/56 248/316.1
2004/0075029 A1 * 4/2004 Clausen ..... D06F 79/02 248/117.1
2006/0157629 A1 * 7/2006 Silverman ..... B65H 75/366 248/311.2
2006/0226321 A1 * 10/2006 Tracy ..... A63B 71/0045 211/85.7
2009/0236477 A1 * 9/2009 Oh ..... H02G 1/04 248/65
2013/0277529 A1 * 10/2013 Bolliger ..... G06F 1/1632 248/676

(Continued)

*Primary Examiner* — Nkeisha Smith

(57) ABSTRACT

A hanging set for ironing boards includes a first hanger including a first connecting part, a first flat part, and a first stopper part. The first flat part is formed between the first connecting part and the first stopper part. The first flat part has a first inclined part extending from one side thereof. A second hanger includes a second connecting part, a second flat part, and a second stopper part. The second flat part is formed between the second connecting part and the second stopper part. The second flat part has a second inclined part extending from one side thereof. An inclination direction of the first inclined part faces towards an inclination direction of the second inclined part. The first and second hangers, can support both T-shaped support legs and the Y-shaped supported legs of an ironing board.

4 Claims, 7 Drawing Sheets

(56) References Cited

U.S. PATENT DOCUMENTS

| | | | | |
|---|---|---|---|---|
| 2014/0245646 | A1* | 9/2014 | Glenn, Jr. | D06F 81/06 38/137 |
| 2018/0084935 | A1* | 3/2018 | Schwab | A47J 45/02 |
| 2022/0048583 | A1* | 2/2022 | Lauzon | B62H 3/08 |
| 2023/0138957 | A1* | 5/2023 | Xu | A47H 1/142 248/265 |
| 2024/0368825 | A1* | 11/2024 | Tabujara | D06F 79/02 |

* cited by examiner

HANGING SET FOR IRONING BOARDS

FIELD OF THE INVENTION

The present invention relates to a hanging set for ironing boards, and more particularly, to hanging set for the purpose of hanging and storing ironing boards.

BACKGROUND OF THE INVENTION

According to different occasions, there are corresponding requirements for the appearance of clothing. For example, in more formal situations, it is generally necessary to wear a clean and tidy suit and shirt. However, shirts are difficult to maintain their clean and tidy appearance after cleaning and drying. Therefore, shirts often need to be ironed to maintain their lines after washing. The iron has a relatively high temperature, so ironing clothes often requires the use of an ironing board.

In addition, since the shape of the ironing board is a long strip with not much height, laying it flat for storage would waste storage space. Therefore, hanging storage is currently the mainstream storage method for ironing boards. However, there is a compatibility issue with the current ironing board hangers on the market. The reason is that current ironing boards come in two types of designs for support legs: T-shaped and Y-shaped. The ironing board hangers on the market can only accommodate one of these two types. For example, a hanger suitable for T-shaped support legs cannot accommodate an ironing board with Y-shaped support legs, and vice versa. Therefore, if a user needs to replace their ironing board (for example, if the original one is damaged and a new one must be purchased), and the design of the support legs is different from the original, they must also replace the original ironing board hanger, which is quite inconvenient.

The present invention intends to provide a hanging set for ironing boards to eliminate the shortcomings mentioned above.

SUMMARY OF THE INVENTION

The present invention relates to a hanging set for ironing boards and comprises a first hanger including a first connecting part, a first flat part, and a first stopper part. The first flat part is formed between the first connecting part and the first stopper part. The first flat part has a first inclined part extending from one side thereof. A first anti-slip piece is attached to the first flat part and the first inclined part. A second hanger includes a second connecting part, a second flat part, and a second stopper part. The second flat part is formed between the second connecting part and the second stopper part. The second flat part has a second inclined part extending from one side thereof. A second anti-slip piece is attached to the second flat part and the second inclined part. An inclination direction of the first inclined part faces towards an inclination direction of the second inclined part.

The primary object of the present invention is to provide a hanging set for ironing boards and comprises a first hanger and a second hanger. When the first hanger and the second hanger are spaced apart, the first flat part of the first hanger and the second flat part of the second hanger can serve as support for hanging an ironing board with T-shaped support legs. Additionally, since the first inclined part of the first hanger and the second inclined part of the second hanger are downwardly inclined towards each other, they can serve as support for hanging an ironing board with Y-shaped support legs. The present invention allows for hanging and storing both ironing boards with T-shaped and Y-shaped support legs, thus effectively addressing the drawback of conventional products that can only accommodate one type of support leg for ironing boards during storage.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
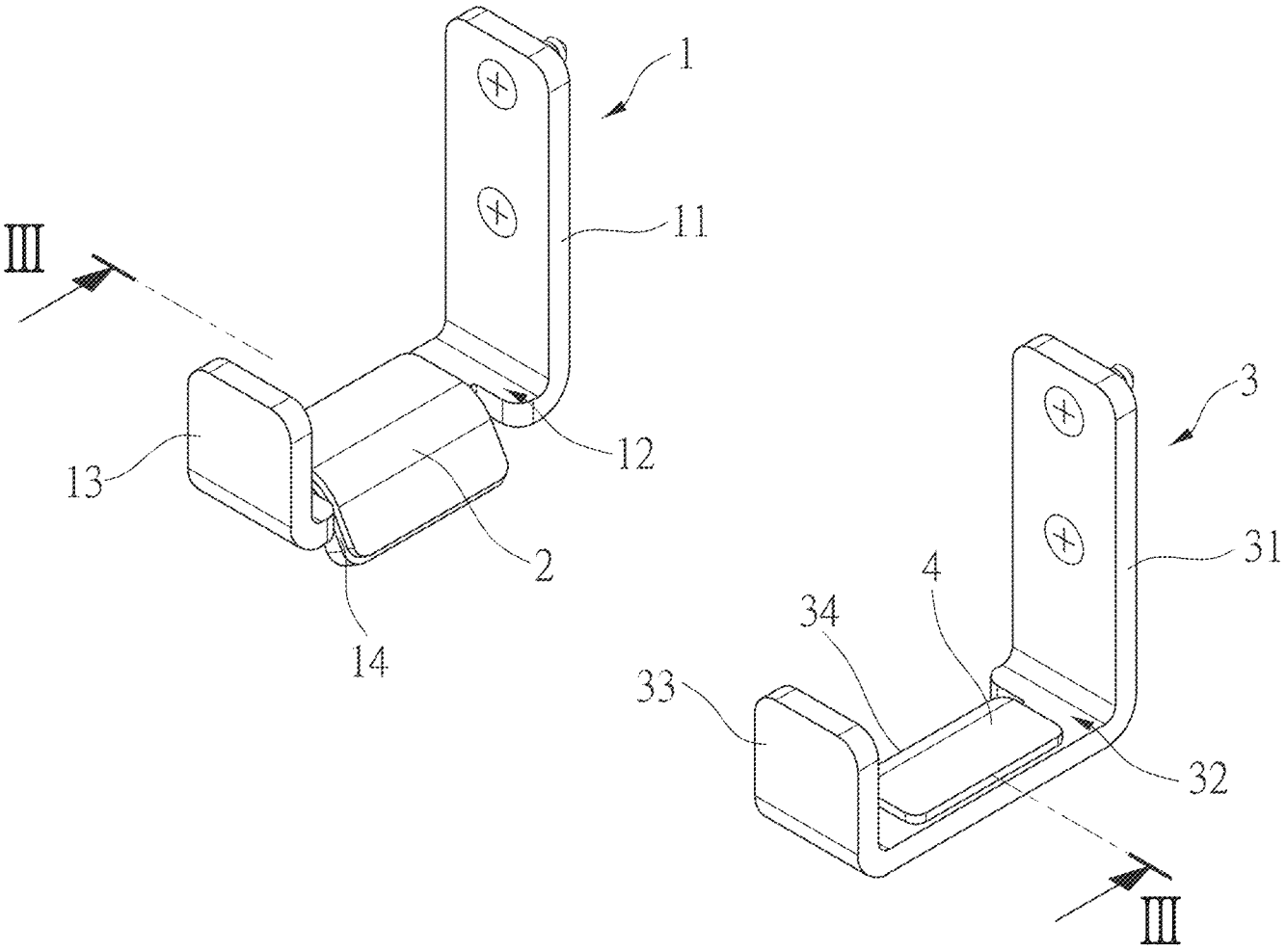
FIG. 1 is a perspective view to show the first hander and the second hanger of the present invention.
Figure 2:
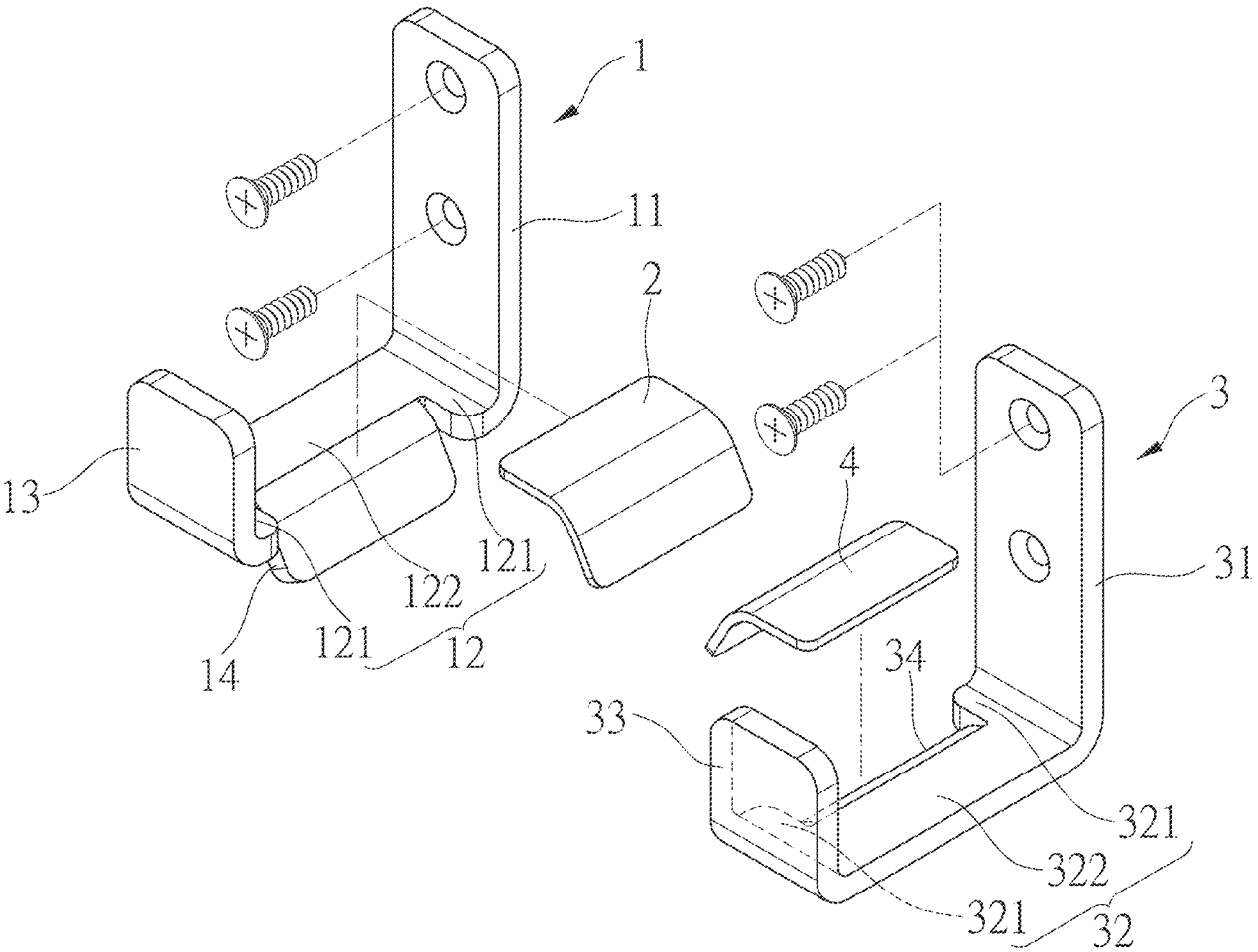
FIG. 2 is an exploded view to show the first hander and the second hanger of the present invention.
Figure 3:
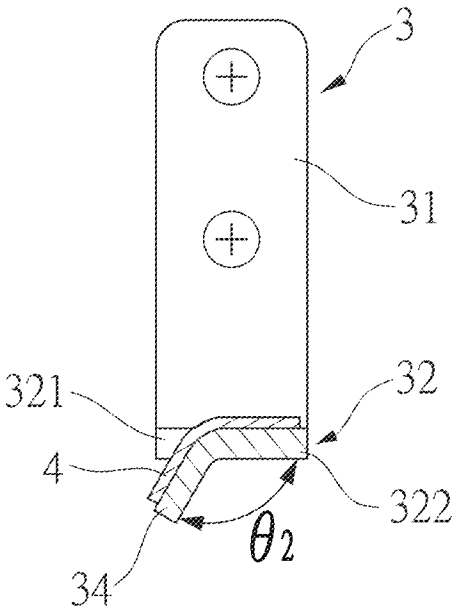
FIG. 3 is an end cross sectional view, taken along line III-III in FIG. 1.
Figure 3:
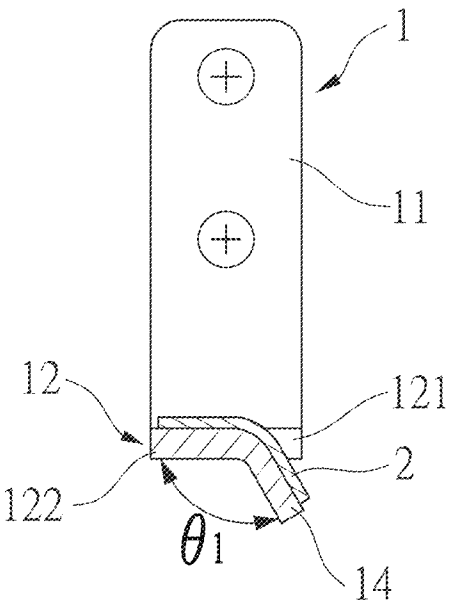

Referring to FIGS. 1-7, the hanging set for ironing boards of the present invention comprises a first hanger (1) including a first connecting part (11), a first flat part (12), and a first stopper part (13). The first flat part (12) is formed between the first connecting part (11) and the first stopper part (13). The first flat part (12) has a first inclined part (14) extending from one side thereof. A first anti-slip piece (2) is attached to the first flat part (12) and the first inclined part (14). A second hanger (3) includes a second connecting part (31), a second flat part (32), and a second stopper part (33). The second flat part (32) is formed between the second connecting part (31) and the second stopper part (33). The second flat part (32) has a second inclined part (34) extending from one side thereof. A second anti-slip piece (4) is attached to the second flat part (32) and the second inclined part (34). When the first and second hangers 1, 2 are fixed apart from each other on a wall by screws as shown in FIGS. 4-7, the inclination direction of the first inclined part (14) faces towards the inclination direction of the second inclined part (34).

Figure 4:
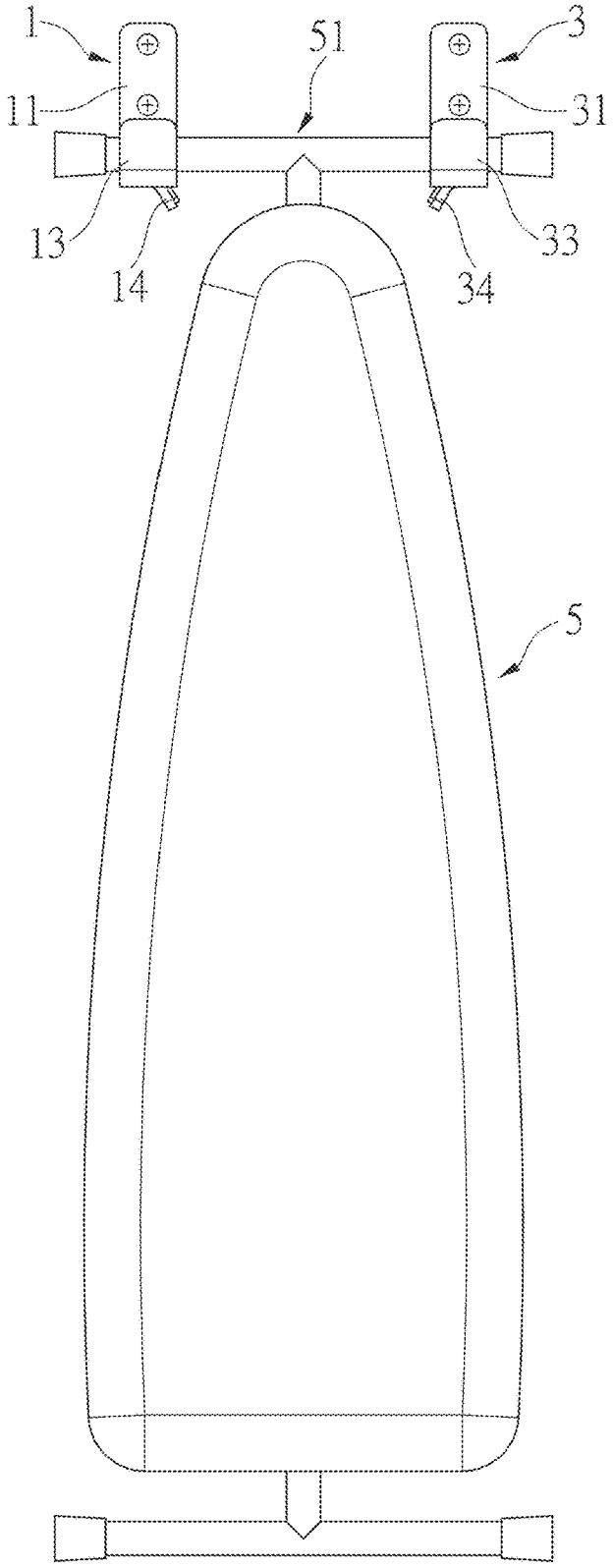
FIG. 4 illustrates the T-shaped support legs of an ironing board is supported by the present invention.
Figure 5:
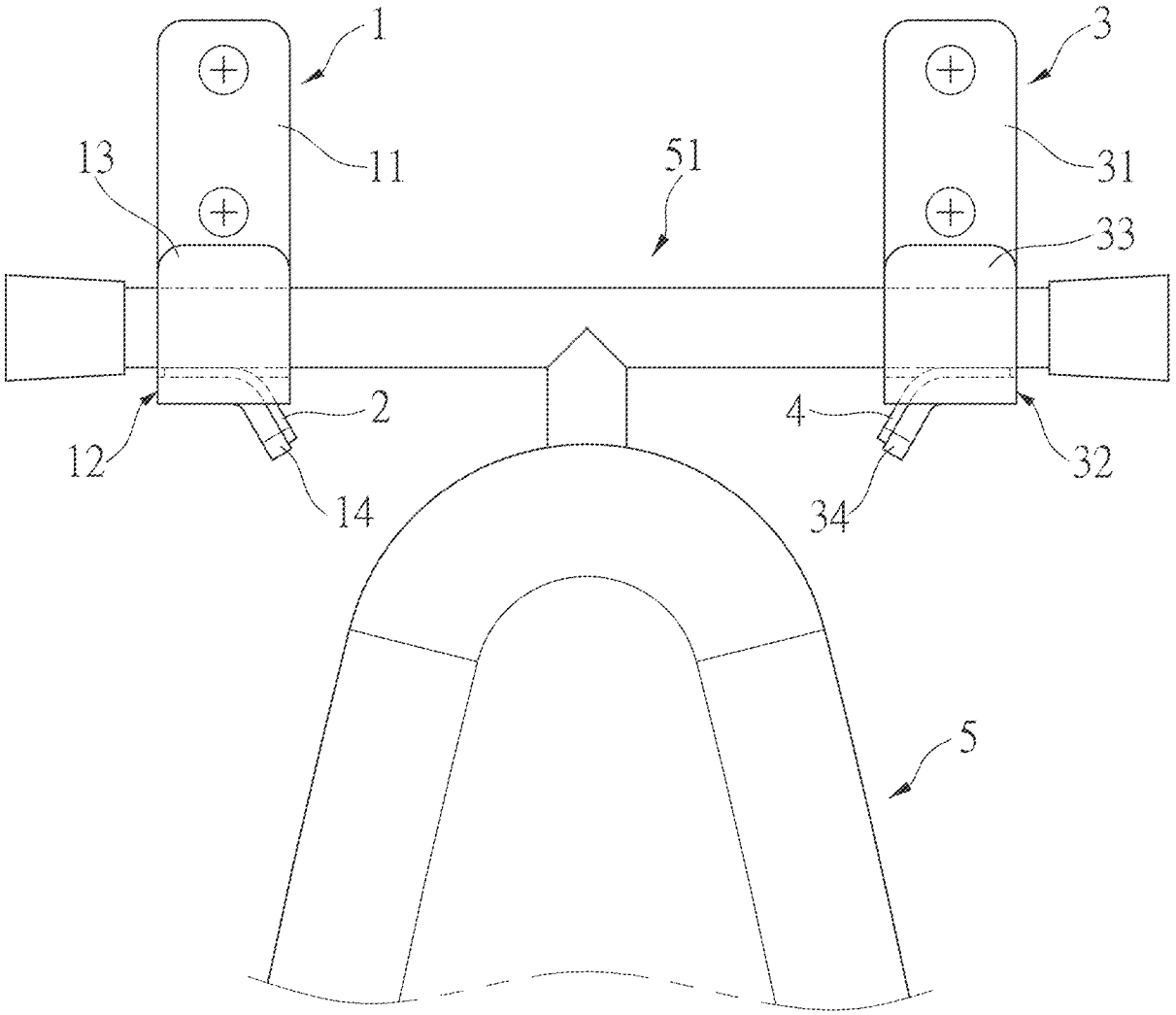
FIG. 5 is an enlarged view to show T-shaped support legs of an ironing board is supported by the present invention.
Figure 6:
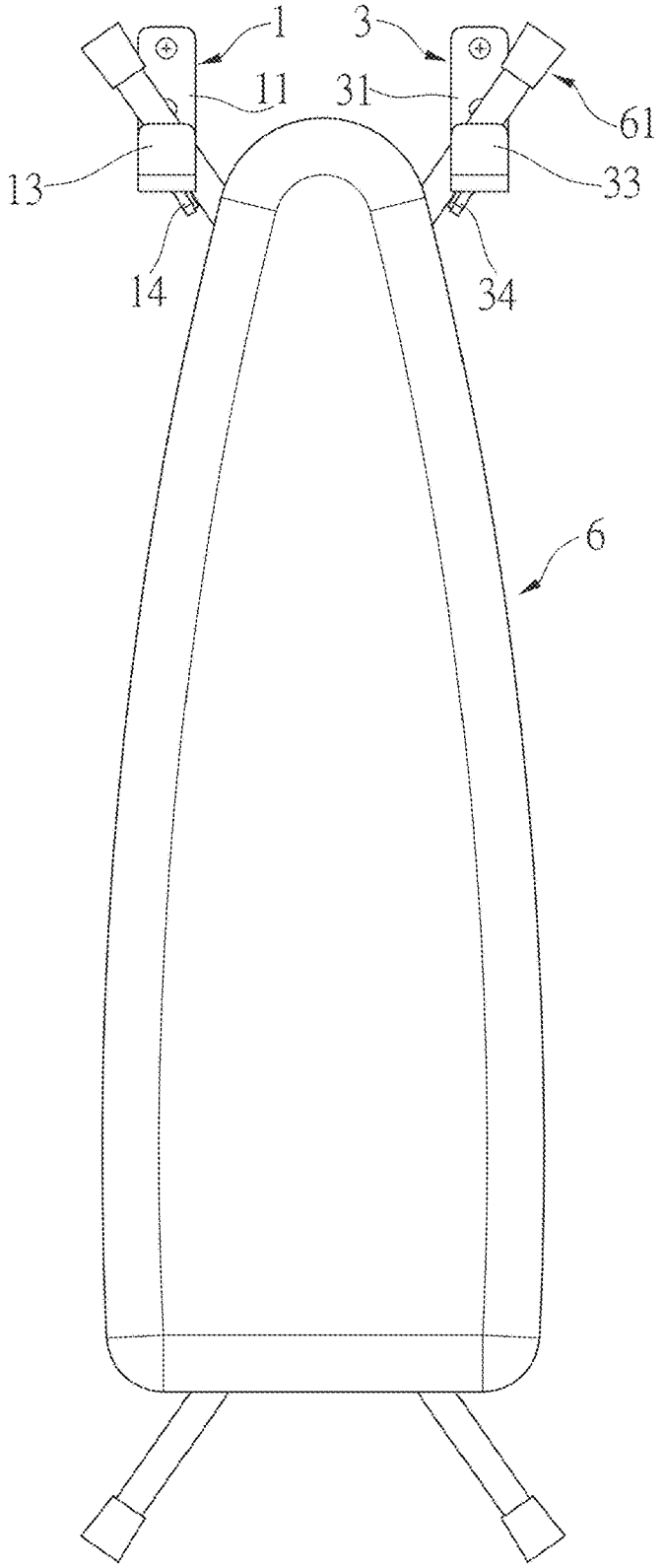
FIG. 6 illustrates the Y-shaped support legs of an ironing board are supported by the present invention.
Figure 7:
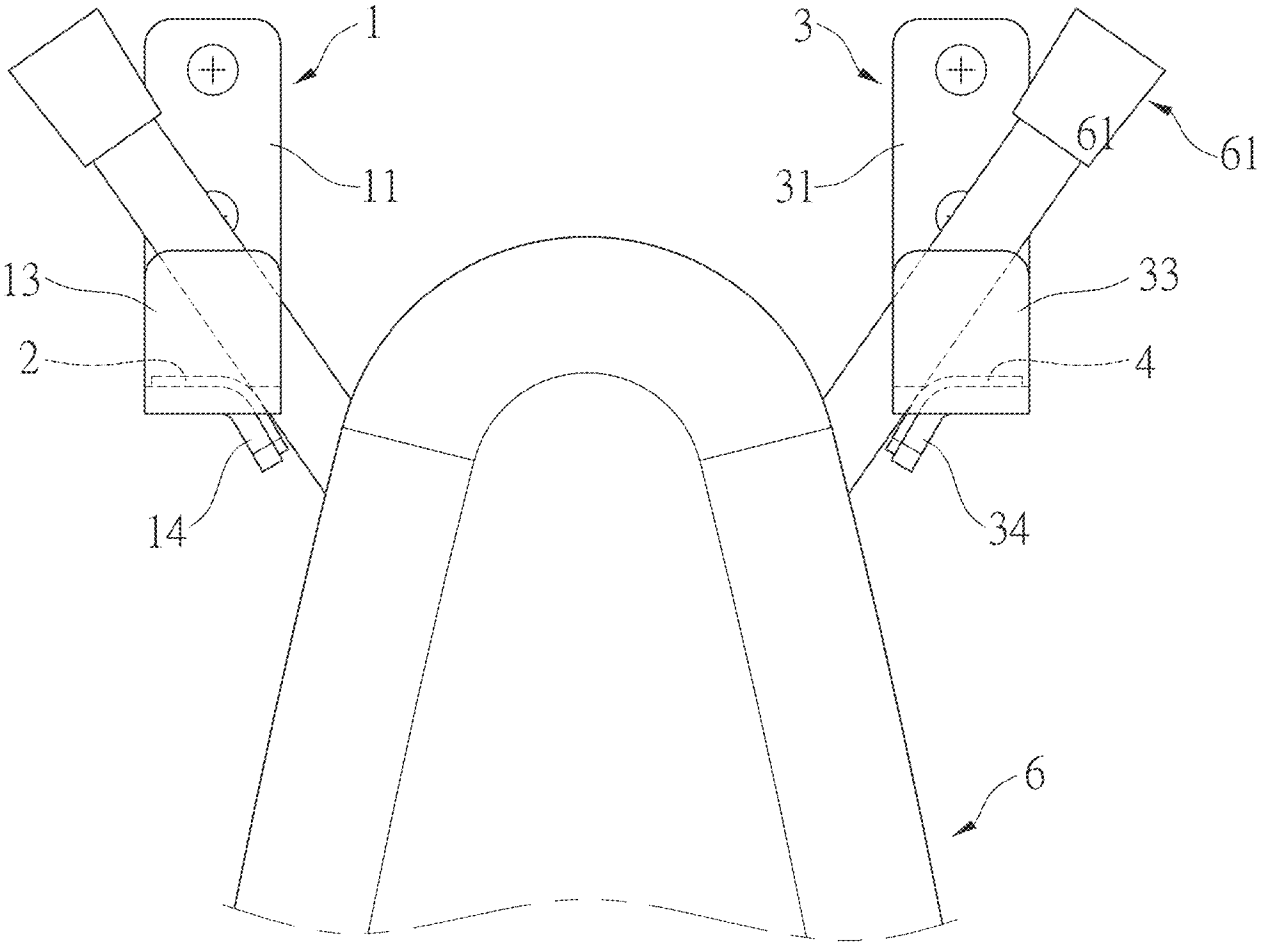
FIG. 7 is an enlarged view to show Y-shaped support legs of an ironing board are supported by the present invention.

When the first hanger (1) and the second hanger (3) are spaced apart and installed on a wall by screws, as shown in FIGS. 4 and 5, the first flat part (12) of the first hanger (1) and the second flat part (32) of the second hanger (3) can serve as support for hanging an ironing board (5) with T-shaped support legs (51). Additionally, as shown in FIGS. 6 and 7, since the first inclined part (14) of the first hanger (1) and the second inclined part (34) of the second hanger (3) are downwardly inclined towards each other, they can serve as support for hanging an ironing board (6) with Y-shaped support legs (61). The present invention allows for hanging and storing both ironing boards (5) with T-shaped support legs (51), and ironing boards (6) with Y-shaped support legs (61). The present invention effectively addresses the drawback of conventional products that can only accommodate one type of support leg for ironing boards during storage.

Additionally, the first anti-slip piece (2) and the second anti-slip piece (4) make it less prone to sliding and stabilize the hanging of the ironing board (5). Furthermore, the first stopper part (13) and the second stopper part (33) reduce the likelihood of T-shaped support legs (51) and Y-shaped support legs (61) slipping away from the wall. Moreover, the first connecting part (11), the first flat part (12), and the first stopper part (13) form a hook-like structure. The second connecting part (31), the second flat part (32) and the second stopper part (33) form a hook-like structure.

A first angle (θ1) is formed between the first flat part (12) and the first inclined part (14). The first angle (θ1) is between 115 degrees and 125 degrees. Preferably, the first angle (θ1) is 120 degrees. A second angle (θ2) is formed between the second flat part (32) and the second inclined part (34). The second angle (θ2) is between 115 degrees and 125 degrees. Preferably, the second angle (θ2) is 120 degrees. These angles are chosen to closely match the typical inclination angle of Y-shaped support legs (61) found in the market.

The first flat part (12) comprises two first wide edge segments (121) and a first narrow edge segment (122). The first narrow edge segment (122) is formed between the two first wide edge segments (121). The first inclined part (14) extends from one side of the first narrow edge segment (122). A difference in height is formed between the first inclined part (14) and the two first wide edge segments (121). The second flat part (32) comprises two second wide edge segments (321) and a second narrow edge segment (322). The second narrow edge segment (322) is formed between the two second wide edge segments (321). The second inclined part (34) extends from one side of the second narrow edge segment (322). A difference in height is formed between the second inclined part (34) and the two second wide edge segments (321). The difference in height provides a stop for limiting the hanging of the Y-shaped support legs (61).

While we have shown and described the embodiment in accordance with the present invention, it should be clear to those skilled in the art that further embodiments may be made without departing from the scope of the present invention.

What is claimed is:

1. A hanging set for ironing boards, comprising:

a first hanger (1) including a first connecting part (11), a first flat part (12), and a first stopper part (13), the first flat part (12) formed between the first connecting part (11) and the first stopper part (13), the first flat part (12) having a first inclined part (14) extending from one side thereof;

the first flat part (12) comprising two first wide edge segments (121) and a first narrow edge segment (122), the first narrow edge segment (122) formed between the two first wide edge segments (121), the first inclined part (14) extending from one side of the first narrow edge segment (122), a difference in height being formed between the first inclined part (14) and the two first wide edge segments (121);

a first anti-slip piece (2) attached to the first flat part (12) and the first inclined part (14);

a second hanger (3) including a second connecting part (31), a second flat part (32), and a second stopper part (33), the second flat part (32) formed between the second connecting part (31) and the second stopper part (33), the second flat part (32) having a second inclined part (34) extending from one side thereof, and a second anti-slip piece (4) attached to the second flat part (32) and the second inclined part (34), an inclination direction of the first inclined part (14) facing towards an inclination direction of the second inclined part (34).

2. The hanging set for ironing boards as claimed in claim 1, wherein a first angle (θ1) is formed between the first flat part (12) and the first inclined part (14), the first angle (θ1) is between 115 degrees and 125 degrees.

3. The hanging set for ironing boards as claimed in claim 1, wherein a second angle (θ2) is formed between the second flat part (32) and the second inclined part (34), the second angle (θ2) is between 115 degrees and 125 degrees.

4. The hanging set for ironing boards as claimed in claim 1, wherein the second flat part (32) comprises two second wide edge segments (321) and a second narrow edge segment (322), the second narrow edge segment (322) is formed between the two second wide edge segments (321), the second inclined part (34) extends from one side of the second narrow edge segment (322), a difference in height is formed between the second inclined part (34) and the two second wide edge segments (321).

* * * * *